United States Patent [19]

Asao

[11] Patent Number: 4,572,893

[45] **Date of Patent: * Feb. 25, 1986**

[54] PHOTOGRAPHIC RESIN-COATED PAPER

[75] Inventor: Yasuzi Asao, Shizuoka, Japan

[73] Assignee: Fuji Photo Film Co., Ltd., Kanagawa, Japan

[ * ] Notice: The portion of the term of this patent subsequent to Jun. 21, 2001 has been disclaimed.

[21] Appl. No.: 437,105

[22] Filed: Oct. 27, 1982

[30] Foreign Application Priority Data

Oct. 29, 1981 [JP] Japan ..... 56-172025

[51] Int. Cl.[4] ..... G03C 1/76

[52] U.S. Cl. ..... 430/532; 430/534; 430/538; 428/144

[58] Field of Search ..... 430/527, 532, 534, 538; 428/144

[56] References Cited

U.S. PATENT DOCUMENTS

| | | | |
|---|---|---|---|
| 3,411,908 | 11/1968 | Crawford et al. | 430/538 |
| 3,853,592 | 12/1974 | Crawford et al. | 430/538 |
| 4,267,166 | 5/1981 | Shibue et al. | 430/527 |
| 4,312,937 | 1/1982 | Kasper et al. | 430/538 |
| 4,353,981 | 10/1982 | Noda et al. | 430/538 |
| 4,389,455 | 6/1983 | Asao | 430/538 |
| 4,442,200 | 4/1984 | Asao | 430/538 |
| 4,443,535 | 4/1984 | Kiritani et al. | 430/538 |

*Primary Examiner*—Jack P. Brammer

*Attorney, Agent, or Firm*—Toren, McGeady, Stanger, Goldberg & Kiel

[57] ABSTRACT

Photographic resin-coated paper comprising a paper sheet and a polyolefin resin layer coated over at least one surface of the paper sheet, in which the polyolefin resin contains titanium dioxide powder coated with an alcohol having 2–18 carbon atoms and 2–4 hydroxyl groups, and the surface of the polyolefin resin layer has been activated by corona discharge or flame.

8 Claims, No Drawings

PHOTOGRAPHIC RESIN-COATED PAPER

This invention relates to a photographic resin-coated paper.

There has been previously employed, as a photographic paper (support), a baryta paper consisting of a paper sheet coated with baryta layer comprising barium sulfate on one surface. Recently, however, a waterproof photographic paper consisting essentially of a paper sheet coated with a hydrophobic polyolefin resin on both surfaces thereof has been developed and employed to cope with the requirement for rapid development process, replacing the conventional baryta paper.

The polyolefin resin-coated paper, as described above, generally consists of a paper sheet coated with polyolefin resin. In the polyolefin resin layer placed on one surface of the paper sheet on which a photographic emulsion layer is to be placed, there is generally contained titanium dioxide powder (pigment) for providing high whiteness and high screen.

However, the conventional paper sheet coated with polyolefin resin containing untreated titanium dioxide powder provides, when employed as the paper support for a photographic material, poor resolution to a printed image, and therefore this photographic material is not said to be a satisfactorily qualified commercial good. For this reason, it has been proposed that a surface active agent such as a metallic soap, e.g., calcium stearate or zinc palmitate be incorporated into the polyolefin resin together with the titanium dioxide powder so as to increase dispersion of the titanium dioxide powder therein. The photographic material employing the so prepared photographic paper (support) provides relatively high resolution as compared with the photographic material employing the photographic paper with no surface active agent, but still does not provide a printed image at a satisfactory level.

Also defective is poor adhesion between the polyolefin resin layer containing the untreated titanium dioxide powder and a photographic emulsion layer or an intermediate layer (subbing layer) to be placed thereon. It is known that the adhesion can be improved by applying an electric, chemical or flame activating treatment to the polyolefin resin layer. However, the adhesion provided by such an activating treatment is still at a relatively low level when the untreated titanium dioxide powder is incorporated into the polyolefin resin layer.

Accordingly, a principal object of the invention is to provide a photographic resin-coated paper containing titanium dioxide powder in the polyolefin resin coating layer, which is capable of imparting high resolution to a printed image produced on a photographic material prepared therefrom.

Another object of the invention is to provide a photographic resin-coated paper containing titanium dioxide powder in the polyolefin resin coating layer, which has sufficient adhesion between the polyolefin resin layer and a photographic emulsion layer or an intermediate layer to be placed thereon.

Other objects of the invention will be seen in the description given below.

The objects of the invention are accomplished by a photographic resin-coated paper comprising a paper sheet and a polyolefin resin layer coated over at least one surface of the paper sheet, in which the polyolefin resin contains titanium dioxide powder coated with an alcohol having 2–18 carbon atoms and 2–4 hydroxyl groups, and the surface of the polyolefin resin layer has been activated by corona discharge or flame.

Preferred embodiments of the invention are now described hereinafter.

In the invention, there is no limitation on the titanium dioxide powder, as far as it is applicable for incorporation into a polyolefin resin layer of a photographic paper. For instance, rutile $TiO_2$ powder or anatase $TiO_2$ powder ranging in particle size of 0.1–5 microns is employed. The titanium dioxide powder may be coated with inorganic material such as silica or alumina, or may be treated with an adequate material.

Among these pre-coated or pre-treated powders, anatase-type titanium dioxide powder coated in advance with hydrated alumina in the amount less than 0.5% by weight of the powder is preferred, because it reduces, after coating with the polyhydric alcohol, yellowing with the passage of time of the prepared photographic resin-coated paper and improves the resolution of the photographic material.

Examples of the polyhydric alcohol having 2–18 carbon atoms and 2–4 hydroxyl groups employable in the invention include: alcohols containing 2 hydroxyl groups in the molecule such as ethylene glycol, propylene glycol, 1,3-dihydroxybutane, 1,4-dihydroxybutane, pentamethylene glycol, 2,5-dihydroxyhexane, 2,4-dihydroxy-2-methylpentane, heptamethylene glycol, and dodecamethylene glycol; alcohols containing 3 hydroxyl groups in the molecule such as trimethylolethane, trimethylolpropane, glycerol, 2,4-dihydroxy-3-hydroxylmethylpentane, 1,2,6-hexanetriol, and 2,2-bis(-hydroxymethyl)-3-butanol; and alcohols containing 4 hydroxyl groups in the molecule such as pentaerythritol.

Alcohols containing only one hydroxyl group in the molecule, and polyhydric alcohols containing 5 or more hydroxyl groups are ineffective for the improvement of high resolution to a printed image produced on the photographic material.

In the invention, the polyhydric alcohol for coating the titanium dioxide powder preferably contains 2–6 carbon atoms and 2–4 methylol groups. More preferably, the polyhydric alcohol contains 4–5 carbon atoms and 3 methylol groups. Particularly, titanium dioxide powder coated with trimethylolethane is highly effective for the improvement of high resolution to a printed image produced on the photographic material.

The polyhydric alcohol is preferably coated over the surface of the titanium dioxide powder in the amount of approximately 0.01–10% by weight of the titanium dioxide powder. Particularly preferred range of the coating amount is approximately 0.1–1.5% by weight of the same. The polyhydric alcohol more than 10% by weight causes increased emitting of smoke and offensive odor in the melt extrusion process, resulting in deterioration of the working atmosphere.

The coating of the titanium dioxide powder with the polyhydric alcohol can be accomplished in a variety of ways. Examples of the coating procedures include: a procedure comprising immersing the titanium dioxide powder in a solvent containing the polyhydric alcohol, recovering the powder from the solution, and removing the solvent from the so recovered titanium dioxide powder through volatilization; a procedure comprising spraying a solvent containing the polyhydric alcohol over the titanium dioxide powder, and removing the solvent from the powder through volatilization; a process comprising mixing a melted polyhydric alcohol with the titanium dioxide powder; and a process comprising pulverizing solid titanium dioxide in the presence of the polyhydric alcohol. Industrially preferred processes are a process comprising pulverizing the titanium dioxide in a hydrodynamic pulverizer such as a micronizer or a jet mill under adding the polyhydric alcohol; and a process comprising mixing the titanium dioxide powder with the polyhydric alcohol in a high shearing mixer such as Henschel mixer or a super mixer.

The titanium dioxide powder coated with the polyhydric alcohol is incorporated into a polyolefin resin generally in the amount of approximately 1–40% by weight, preferably 5–20% by weight, of the resin, in view of whiteness and screening effect.

In the invention, the polyolefin resin preferably has melt index (MI) in the range of 1–40 g./10 min., more preferably 5–30 g./10 min. This melt index value is determined in accordance with the measurement procedure defined in JIS K 6760 - 1966.

Examples of the polyolefin resins of the invention include ethylene homopolymers such as high density polyethylene and low density polyethylene, propylene homopolymers, and copolymers of ethylene with one or more copolymerizable monomers. When the ethylene copolymer is selected, the copolymerizable monomer preferably amounts to not more than 10% by weight of the ethylene content. Examples of the copolymerizable monomers include alfa-olefins such as styrene, vinyl stearate, vinyl acetate, acrylic acid, methyl acrylate, ethyl acrylate, acrylamide, methacrylic acid, methyl methacrylate, ethyl methyacrylate, methacrylamide; and diene compounds such as butadiene and isoprene. The polyolefin resin can be employed alone or in combination.

Incorporation of the titanium dioxide powders coated with the polyhydric alcohol into the polyolefin resin can be carried out by a conventional method such as the melt extrusion process using a kneading extruder, a heating roll mill, a Banbury mixer, or a kneader.

Preferably, the incorporation of the coated titanium dioxide powder into the polyolefin resin is carried out through preparation of a master batch. More in detail, the coated titanium dioxide powder is incorporated into the polyolefin resin in the amount of approximately 10–60% by weight,preferably 20–40% by weight, of the resin. The so prepared polyolefin resin composition containing a large amount of the coated titanium dioxide powder is diluted with a simple polyolefin resin when subjected to the melt extrusion.

The polyolefin resin composition may further contain a variety of additives such as fluorescent whitening agent, antioxidizing agent, antistatic agent, releasing agent, dye and dispersing agent, if desired.

There is no limitation on material of the paper sheet, as far as the material is able to serve as support of a photographic material. Examples of the materials of the paper sheet include natural pulp, synthetic pulp, and their mixtures. The thickness of the paper sheet generally ranges from approximately 20 μm to approximately 400 μm, and preferably ranges from 70 μm to 250 μm. The basis weight of the paper sheet generally ranges from approximately 15 g./m$^2$ to approximately 350 g./m$^2$, and preferably ranges from 50 g./m$^2$ to 200 g./m$^2$. The paper sheet may contain conventional agents such as paper strength increasing agent, sizing agent, dye, fluorescent whitening agent, a preserving agent, filler, and antistatic agent, if desired.

The paper sheet is coated with the polyolefin resin containing the titanium dioxide powder coated with the aforementioned polyhydric alcohol and, if desired, further containing one or more additives, for instance, through melt extrusion. The thickness of the polyolefin resin layer coated on the surface of the paper sheet is in the range of approximately 5–200 μm, preferably 10–40 μm.

In the present specification, the (melt) extrusion means a procedure comprising coating a running paper sheet with a polyolefin resin composition in the form of film extruded in melted state through a slit die from an extruder. In the procedure, the polyolefin resin composition is in melted state under heating to approximately 250°–350° C., preferably 280°–320° C. The paper sheet runs at the rate of approximately 50–500 m/min., preferably 80–250 m/min. Examples of the slit dies include flat dies such as T-die, L-die and fishtail die. The slit gap preferably ranges from approximately 0.1 to 1.5 mm.

The so prepared polyolefin resin-coated paper is then subjected to a surface activation treatment selected from those consisting of corona discharge treatment and flame treatment.

The corona discharge treatment is known to those skilled in the art and can be carried out in the manner disclosed in U.S. Pat. No. 3,411,908. The corona discharge treatment for the invention is preferably carried out at 1–10 kVA.sec/m$^2$, more preferably 2–6 kVA.sec/m$^2$.

The flame treatment is also known to those skilled in the art and can be carried out in the manner disclosed in Japanese Patent Provisional Publication No. 52(1977)-121,683 and U.S. Pat. No. 3,640,788. The flame can be prepared by burning paraffinic or olefinic hydrocarbon gas with oxygen. Preferred examples of the hydrocarbon gases include methane, ethane, propane, ethylene, and propylene. A mixture of these gases can be also employed.

In the flame treatment, the flame can be applied through a burner to a surface of a resin-coated paper running at the rate of 50–400 m/min.

The so prepared polyolefin resin-coated paper can be given further treatments generally applied to a conventional photographic support, if desired. These treatments are known to those skilled in the art and exemplified by a hydrophilic treatment for improving the adhesion of the resin surface to a photographic emulsion layer, and a patterning treatment by means of a patterning roll having an engraved pattern thereon to produce an embossed pattern on the surface of the resin layer. The patterning can be applied to the polyolefin resin layer prior to the activation-processing through the corona discharge or flame.

A photographic material can be prepared by a placing a photographic emulsion on the activated surface of the polyolefin resin-coated paper.

The photographic emulsion can be directly placed on the polyolefin resin-coated paper to prepare a photographic material. Preferably, an intermediate layer (subbing layer) comprising a pre-coating agent is placed between the polyolefin resin-coated paper and the photographic emulsion layer to increase adhesion therebetween. In general, the pre-coating agent consists essentially of gelatin.

The intermediate layer can be placed on the resin-coated paper by coating on the activated surface thereof with an aqueous gelatin solution or a mixture (dispersion) of an aqueous gelatin solution and a water-miscible solvent. There is no limitation on the gelatin, as far as it is able to serve as the pre-coating agent. Examples of the gelatins include acid-treated gelatin, alkali-treated gelatin, and a gelatin denatured by phthalic acid, styrene or the like. The pre-coating solution can contain additives such as a surface active agent, a viscosity increasing agent, and a film hardening agent, if desired.

The pre-coating solution can be coated on the activated surface of the polyolefin resin layer in a variety of ways. Examples of the coating procedures include gravure coating, air-knife coating, bar coating and blade coating. The coating speed preferably is in the range of 50–400 m/min. The pre-coating agent is preferably coated in the amount of 0.01–5 g./cm$^2$ (based on dry amount of the principal component such as gelatin), more preferably 0.1–2 g./cm$^2$ over the activated surface of the polyolefin resin layer.

The photographic emulsion layer is placed on the activated surface of the polyolefin resin layer directly or on the intermediate layer provided thereonto. Examples of the photographic emulsion layers include a silver halide emulsion layer, an image-receiving layer for the diffusion transfer system, and an organic photosensitive emulsion layer.

The photographic material employing the polyolefin resin-coated paper of the present invention provides remarkably improved resolution as compared with the photographic material employing the conventional polyolefin resin-coated paper containing a simple titanium dioxide powder alone or together with a surface active agent does.

Other advantages of the invention reside in that a photographic material prepared from the polyolefin resin-coated paper (support) of the invention is almost free from separation of the photographic emulsion layer from the support, because the activated surface of the polyolefin resin layer shows improved adhesion to the photographic emulsion layer or an optionally given intermediate layer.

Also advantageous is the fact that a photographic material prepared from the polyolefin resin-coated paper of the invention shows less fog on a printed image than the photographic material prepared from the conventional polyolefin resin-coated paper containing a simple titanium dioxide powder does.

The present invention is now illustrated by the following examples, but these examples by no means restrict the invention.

In the examples, the resolution (resolving power) was evaluated in the following manner.

A polyolefin resin-coated paper is coated with a photographic emulsion, and a resolution evaluation test piece consisting of series of alternating black and white lines of increasing narrowness set in geometric patterns is printed thereon. The variation of optical density of the printed chart image is then determined with Microphotometer (microdensitometer produced by Union Optics Co., Ltd., Japan).

The so determined values are calculated in accordance with the following equation to give the resolution value.

$$\text{Resolution Value (\%)} = \frac{\text{Difference of optical density between the exposed portion and the unexposed portion of 5 lines/mm-piece printed image}}{\text{Difference of optical density between the exposed portion and the unexposed portion of 0.1 line/mm-piece printed image}} \times 100$$

The so calculated resolution value has close relationship with a visual evaluation result, and indicates that a high value means high resolution.

EXAMPLES

A paper sheet (LBKP 100%, weight: 175 g./m$^2$, thickness: 180 μm) was coated with polyethylene (density: 0.920 g./cc., MI: 5.0 g./10 min.) containing the following titanium dioxide powder in the amount of 10% by weight of the polyethylene, through melt extrusion, to prepare a polyethylene coating layer of thickness of 30 μm.

(A) Test Samples Nos. 1–3: anatase-type titanium dioxide powder coated with 2,4-dihydroxy-2-methylpentane prepared by immersing the titanium dioxide powder in an ethanol solution of 2,4-dihydroxy-2-methylpentane, recovering the titanium dioxide powder therefrom, and then removing the solvent from the so recovered titanium dioxide powder.

(B) Test Samples Nos. 4–6: anatase-type titanium dioxide powder coated with trimethylolpropane prepared by pulverizing the titanium dioxide in the presence thereof in a jet mill.

(C) Test Samples Nos. 7–9: anatase-type titanium dioxide powder coated with trimethylolethane prepared by pulverizing the titanium dioxide in the presence thereof in a jet mill.

(D) Test Sample No. 10 (for comparison): non-coated anatase-type titanium dioxide powder.

The so prepared resin-coated paper was passed under a corona discharge generated by 4 kVA.sec/m$^2$ through a corona discharge treatment apparatus (produced by Pillar Corp.) to obtain a photographic resin-coated paper.

The so treated resin-coated paper was then coated with a pre-coating agent consisting of a mixture of 50 g. of gelatin, 400 ml of water and 600 ml of methanol, in the amount of 0.5 g./m$^2$ by dry weight of gelatin to prepare an intermediate layer. A photographic silver halide emulsion layer was further placed on the intermediate layer to prepare a photographic material.

The photographic material was printed with a test piece for the evaluation of resolution, and evaluated for the resolution.

The results of the evaluation for resolution are set forth in Table 1.

TABLE 1

| Test Sample No. | $TiO_2$ Powder | Polyhydric Alcohol | Amount (wt. %) | Resolution Value (%) |
|---|---|---|---|---|
| 1 | A | 2,4-dihydroxy- | 0.02 | 52.0 |
| 2 | A | 2-methylpentane | 0.5 | 53.5 |
| 3 | A | | 1.5 | 53.6 |
| 4 | B | trimethylol- | 0.02 | 52.5 |
| 5 | B | propane | 0.5 | 53.8 |
| 6 | B | | 1.5 | 53.9 |
| 7 | C | trimethylol- | 0.02 | 53.5 |
| 8 | C | ethane | 0.5 | 55.9 |
| 9 | C | | 1.5 | 56.0 |

TABLE 1-continued

| Test Sample No. | $TiO_2$ Powder | Polyhydric Alcohol | Amount (wt. %) | Resolution Value (%) |
|---|---|---|---|---|
| 10 | D | — | — | 47.5 |

The photographic materials employing the Test Samples Nos. 1–9 had so high adhesion between the resin-coated paper and the intermediate layer that these were free from separation between the polyethylene layer and the intermediate layer placed thereon, in the course of the development and fixing procedures.

I claim:

1. A photographic paper comprising a paper sheet, a polyolefin resin layer coated over at least one surface of the paper sheet, and a photographic emulsion superposed on the resin layer, said polyolefin resin containing titanium dioxide powder coated with an alcohol having 2 to 6 carbon atoms and 2 and 4 hydroxyl groups in an amount of 0.01 to 10 percent by weight of the titanium dioxide powder, the titanium dioxide powder being contained in an amount of 1 to 40 percent by weight of polyolefin resin layer, and the surface of the polyolefin resin layer on which the photographic emulsion layer is superposed has been activated by corona discharge or flame.

2. The photographic paper as claimed in claim 1 in which the alcohol contains 2–6 carbon atoms 2–4 methylol groups.

3. The photographic paper as claimed in claim 1 in which the alcohol contains 3 methylol groups.

4. The photographic paper as claimed in claim 1 in which the alcohol is trimethylolethane.

5. The photographic paper as claimed in claim 1 in which the alcohol is coated over the titanium dioxide powder in the amount of about 0.1 to about 1.5 percent by weight of the titanium dioxide powder.

6. The photographic paper as claimed in claim 1 in which the titanium dioxide powder is coated with an inorganic material prior to coating with the alcohol.

7. The photographic paper as claimed in claim 1 in which the inorganic material is silica or alumina.

8. The photographic paper as claimed in claim 1 in which the polyolefin resin is a polyethylene resin.

* * * * *

UNITED STATES PATENT AND TRADEMARK OFFICE

CERTIFICATE OF CORRECTION

PATENT NO. : 4,572,893

DATED : February 25, 1986

INVENTOR(S) : Yasuzi Asao

It is certified that error appears in the above-identified patent and that said Letters Patent is hereby corrected as shown below:

The heading of the Patent should read as follows:

[21] Appl. No.: 437,015

Signed and Sealed this

*Twenty-second* Day of *July 1986*

[SEAL]

*Attest:*

DONALD J. QUIGG

*Attesting Officer*

*Commissioner of Patents and Trademarks*